US005461802A

United States Patent [19]

Paris et al.

[11] Patent Number: 5,461,802

[45] Date of Patent: Oct. 31, 1995

[54] SKI BOOT WITH ADJUSTABLE SLANT OF THE UPPER

[75] Inventors: Jean Paris, Sevrier; Jean-Pierre Chemello, Annecy-Le-Vieux, both of France

[73] Assignee: Salomon S.A., Metz-Tessy, France

[21] Appl. No.: 365,794

[22] Filed: Dec. 29, 1994

[30] Foreign Application Priority Data

Jan. 12, 1994 [FR] France ..... 94 00402

[51] Int. Cl.[6] ..... A43B 5/04

[52] U.S. Cl. ..... 36/121; 36/120

[58] Field of Search ..... 36/117–121, 109, 36/89, 105, 114, 115, 50.5

[56] References Cited

U.S. PATENT DOCUMENTS

| | | | |
|---|---|---|---|
| 4,922,632 | 5/1990 | Arieh et al. | 36/117 |
| 4,934,075 | 6/1990 | Benetti | 36/120 |
| 5,259,127 | 11/1993 | Pallatin | 36/117 |
| 5,265,352 | 11/1993 | Chemello | 36/120 |

FOREIGN PATENT DOCUMENTS

| | | |
|---|---|---|
| 0358599 | 3/1990 | European Pat. Off. . |
| 0364398 | 4/1990 | European Pat. Off. . |
| 2020726 | 7/1970 | France . |
| 2682859 | 4/1993 | France . |
| 1951758 | 5/1970 | Germany . |
| 682621 | 10/1993 | Switzerland . |

*Primary Examiner*—Jimmy G. Foster
*Assistant Examiner*—Thomas P. Hilliard
*Attorney, Agent, or Firm*—Sandler, Greenblum, & Bernstein

[57] ABSTRACT

The invention is related to alpine ski boot including a rigid shell base overlaid by an upper that has a front portion and a rear portion, the latter being at least partially pivotal with respect to the shell base and including a latching and unlatching device with respect to the shell base, accessible from the exterior of the boot via a control member, the latching position of the latter, corresponding to an initial adjustable reference advance position, from which the upper is capable of an angular clearance along an amplitude predetermined with respect to the shell base. The latching and unlatching device includes a multi-position member capable of being displaced angularly about a longitudinal axis (X–X') of the shell base in a corresponding coaxial housing arranged in the rear portion thereof, and includes a plurality of orifices radially off-centered with respect to its virtual center, such that one of these orifices, chosen as a function of the initial desired advance of the upper, can be brought into a vertical axis to coincide with a latching finger affixed to the upper.

10 Claims, 7 Drawing Sheets

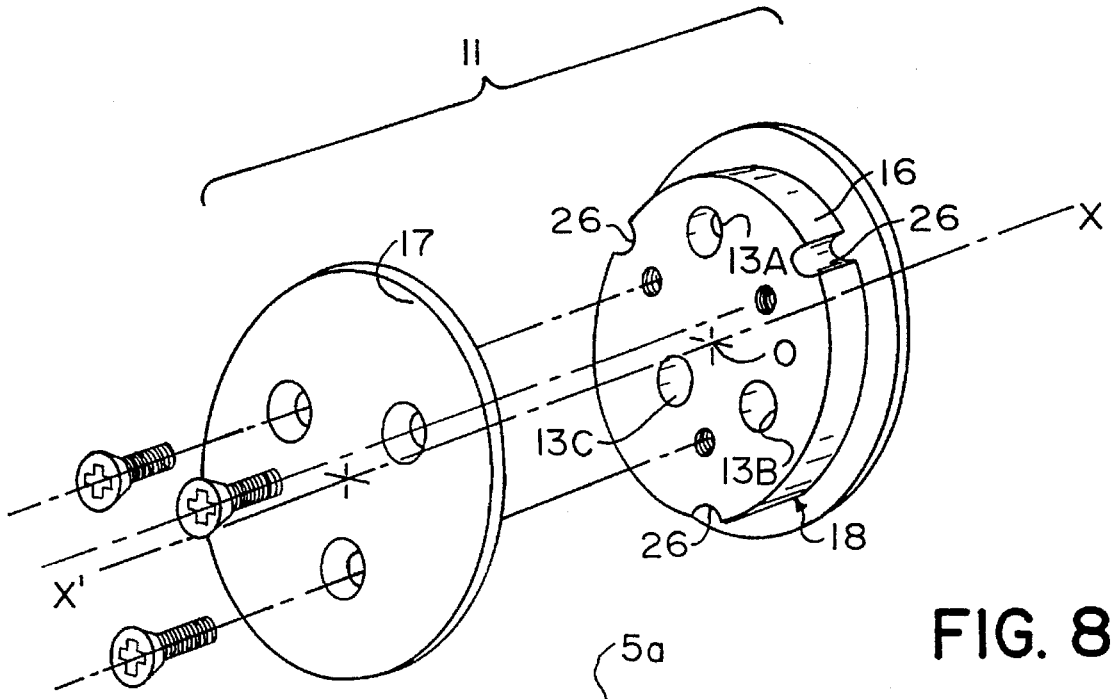
FIG. 8
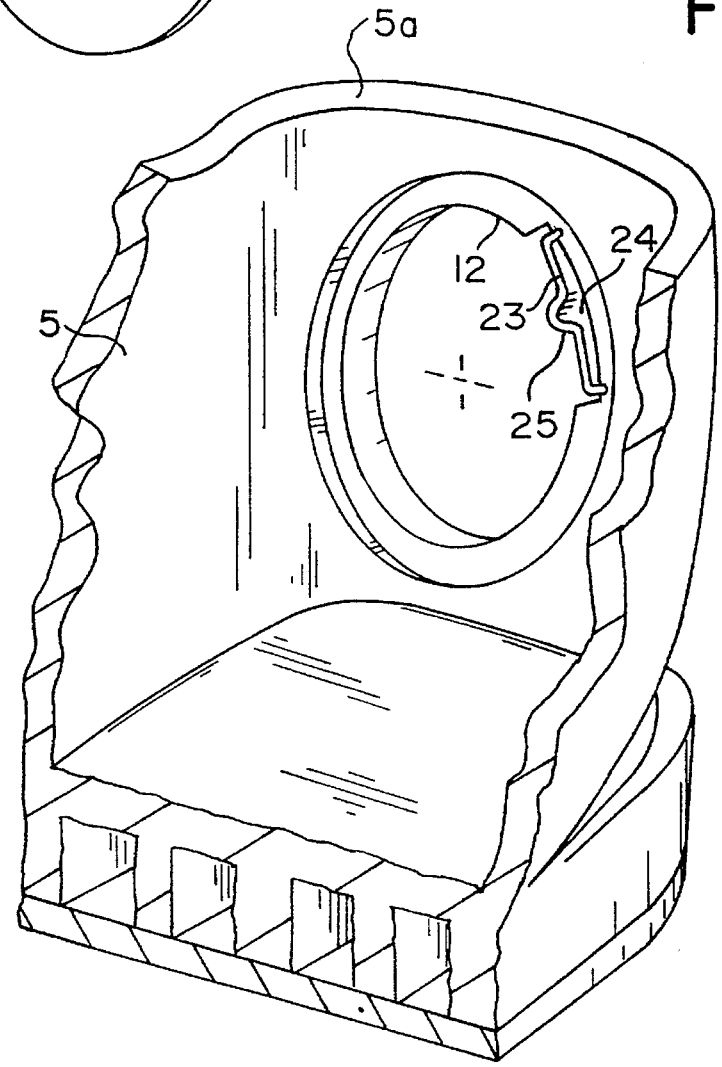

SKI BOOT WITH ADJUSTABLE SLANT OF THE UPPER

BACKGROUND OF THE INVENTION

1. Field of the Invention

The present invention is related to an alpine ski boot including a rigid shell base overlaid by an upper that has a front portion and a rear portion provided in one or several pieces, the rear portion of the upper being at least partially pivotable in the rear-to-front direction and/or the front-to-rear direction with respect to the shell base, and including a device for latching and unlatching with respect to the shell base.

2. Discussion of Background and Material Information

The latching device is accessible from the exterior of the boot via a control member, the latching position of the latter corresponding to an initial adjustable reference advance position, from which portion the upper is capable of an angular clearance along an amplitude predetermined with respect to the shell base.

French Patent Publication No. 2,020,726 discloses the angular adjustment of the upper with respect to the shell base by means of a metallic tongue, affixed to the upper, having a free end provided with an anchoring tooth adapted to cooperate selectively with any one of several housings provided in a plate attached to the external surface of the shell base.

According to this publication, three successive housings corresponding to the anchoring tooth are located on the plate vertically and substantially on the median axis of the latter; thus depending on whether the anchoring tooth is inserted into a more or less raised housing, the upper of the boot slants more or less toward the front, i.e., its initial advance position with respect to the shell base is more or less substantial. Also according to this publication, the three successive housings are situated between two oblong housings, or lateral grooves, also provided on the plate and adapted to receive the anchoring tooth; thus, if the skier wishes certain pivoting freedom of the upper, especially for walking, he engages, according to his choice, the anchoring tooth in one of the oblong housings.

In this device, the activating metal tongue and the plate are arranged on the exterior of the upper and the shell base, and constitute unaesthetic protuberances. In addition, at the time of release of the tongue in order to facilitate walking, notably by placing the anchoring tooth in one of the lateral oblong housings, nothing allows the skier to automatically resume the initial advance position of the upper prior to release.

SUMMARY OF THE INVENTION

An object of the present invention is to overcome the aforementioned disadvantages by providing a simple and efficient means for adjusting the advance of the upper, providing the latter with positive positions and allowing it to resume the chosen position automatically in case of successive unlatching and re-latching.

The invention also seeks to provide an adjustment device wherein the means which it implements can neither be removed nor lost, and are easily accessible in view of the adjustment of a single piece.

To this end, the invention relates to a boot such as that described above wherein the device for latching in position and unlatching includes a multi-position member capable of being angularly displaced about a longitudinal axis of the shell base in a corresponding co-axial housing arranged in the rear portion of the latter, and comprising a plurality of radially off-centered openings with respect to its virtual center according to values of different radii, such that one of these orifices, chosen as a function of the desired angle of the initial advance of the upper, can be brought into a vertical axis to coincide with a latching finger affixed to the upper, and can be activated from the exterior through the wall of the upper by the control member in order to cooperate positively with the chosen opening of the multi-position member during an active phase of skiing, or separated therefrom in a resting or walking phase.

Preferably, this device is located in the lower zone of the rear portion of the upper corresponding to the heel, so as to leave the upper portion of the upper free for other functions.

According to another advantage of the invention, the latching and unlatching device allows a forward flexion of the upper from the chosen adjustment point as well as a taking of rear support.

BRIEF DESCRIPTION OF THE DRAWINGS

The invention will be more fully described and other characteristics and advantages of the invention will become apparent from the description that follows with reference to the annexed drawings that are provided only as non-limiting examples thereof.

FIG. 8 is a detailed view, in exploded perspective, of the adjustment member, showing its assembly on the rear portion of the shell base.

DETAILED DESCRIPTION OF THE PREFERRED EMBODIMENTS

Figure 1:
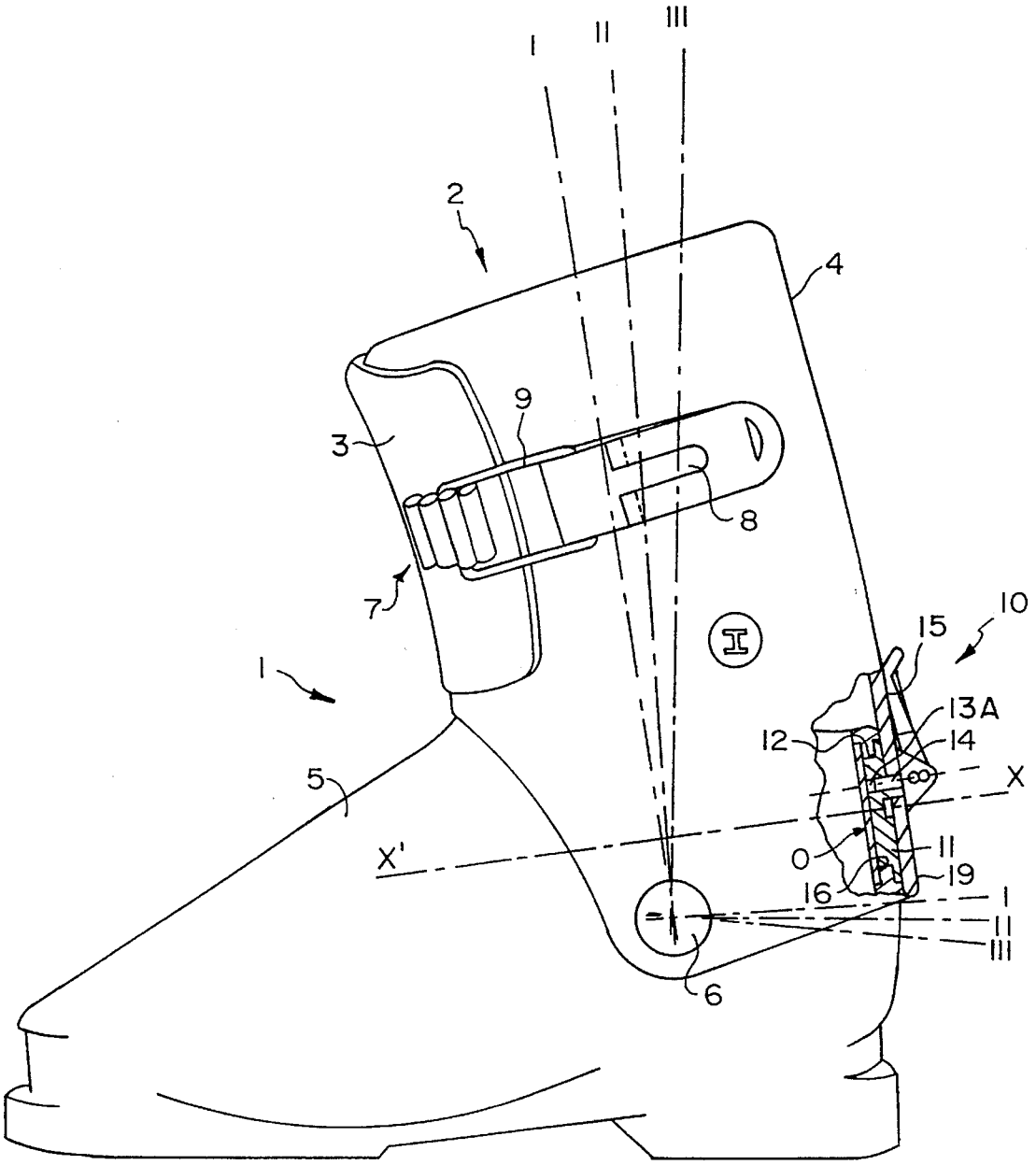
FIG. 1 is a elevation side view of a ski boot of which one part, seen in a vertical section, shows the means for adjusting the advance of the upper, according to the invention, shown in a latched position.

According to the invention, the ski boot 1 includes an upper 2 having a front portion 3, and a rear portion 4 or rear spoiler, and a shell base 5, to which rear portion 4 of the upper 2 is connected via rivets 6, the front portion 3 of the upper 2 being comprised of the extension of the sides of rear portion 4 that overlap. It is clear that the front portion can also include a cuff such as is known in conventional rear entry liners, rear portion 4 then including the rear spoiler for closing the upper.

A system for tightening and closing the upper 2 at the lower part of the skier's leg includes, in a known manner, a tensioning lever 8 that secures in tension a traction element such as a cable buckle 9 partially surrounding the upper 2 at its front portion 3 in order to be tensioned by the lever 8 fixed, for example, to the lateral wings extending from the rear spoiler 4.

According to the invention, the latching and unlatching device 10, generally designated, includes a multi-position member 11 capable of being displaced angularly about a longitudinal axis X–X' of the shell base 5 in a corresponding coaxial housing 12 arranged in the rear portion 5*a* of the shell base, and including a plurality of orifices 13A, 13B, 13C, radially off-centered with respect to its virtual center "0" according to different values of radius r, r1, r2 (seen in FIGS. 5–7), such that one of these orifices 13A, 13B, 13C, chosen as a function of the desired initial advance of the upper 2, can be brought into a vertical axis Y–Y' in order to coincide with a latching finger 14 affixed to the upper 2 and being capable of activation from the exterior through the wall of the latter by the control member 15 in order to cooperate positively with the chosen orifice 13A, 13B, 13C of the multi-position member 11 during an active phase of skiing or separated therefrom in a resting or walking phase.

According to the present embodiment, the multi-position member 11 is a cylindrical plate arranged to swivel freely in the housing 12 of the shell base 5, having a corresponding shape.

The plate 11 includes a peripheral shoulder 16 defining, together with an attached counter plate 17, a groove 18 that is suited to cooperate with a flange 19, of a corresponding shape, bordering the housing 12 of the shell base 5. Thus, plate 11 is affixed to the shell base 5 in its longitudinal direction and therefore cannot be lost.

Figure 2:
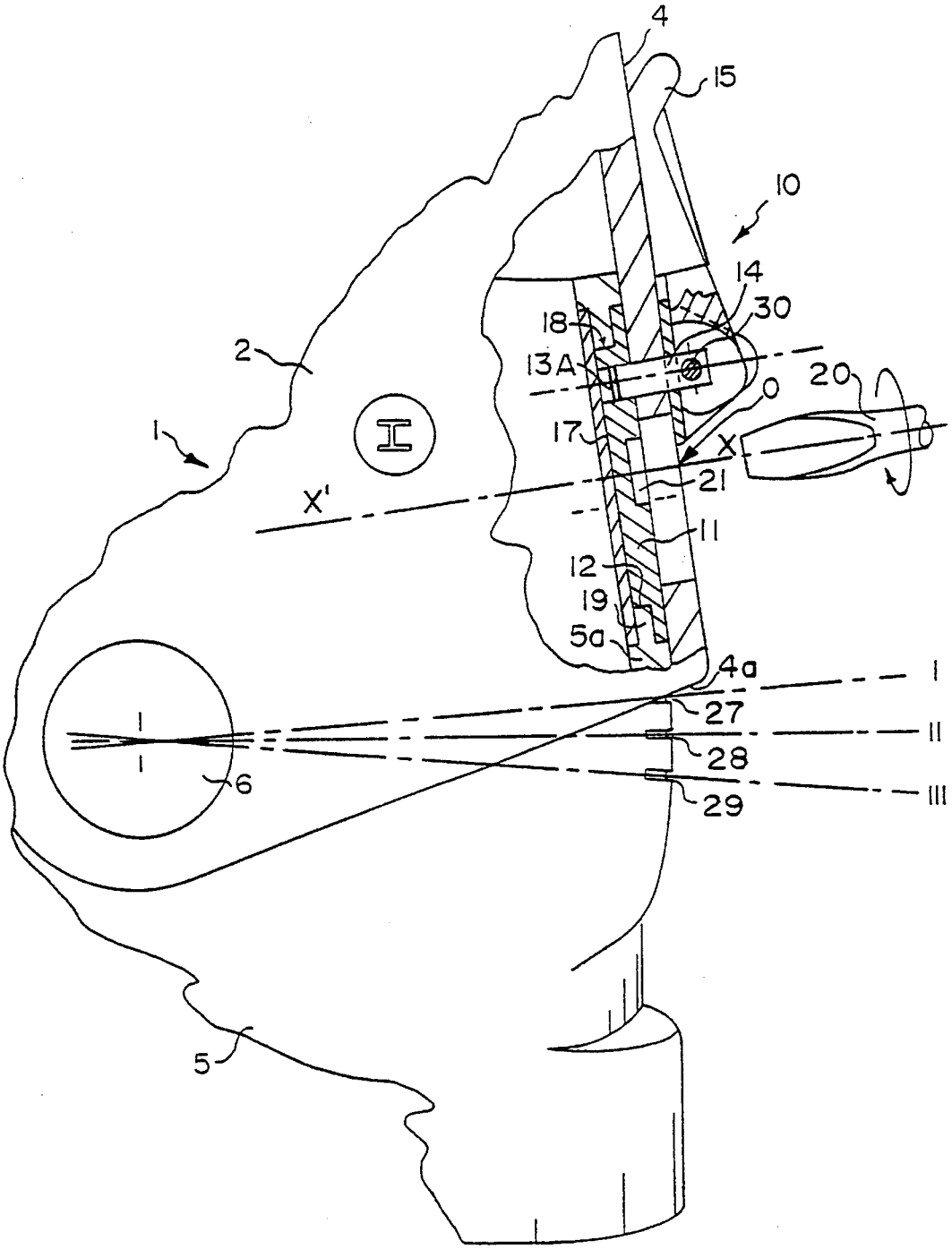
FIGS. 2 and 3 are larger scale and partial sectional views of a boot according to FIG. 1, showing the upper of the boot latched according to the maximum and minimum advance positions, respectively.
Figure 3:
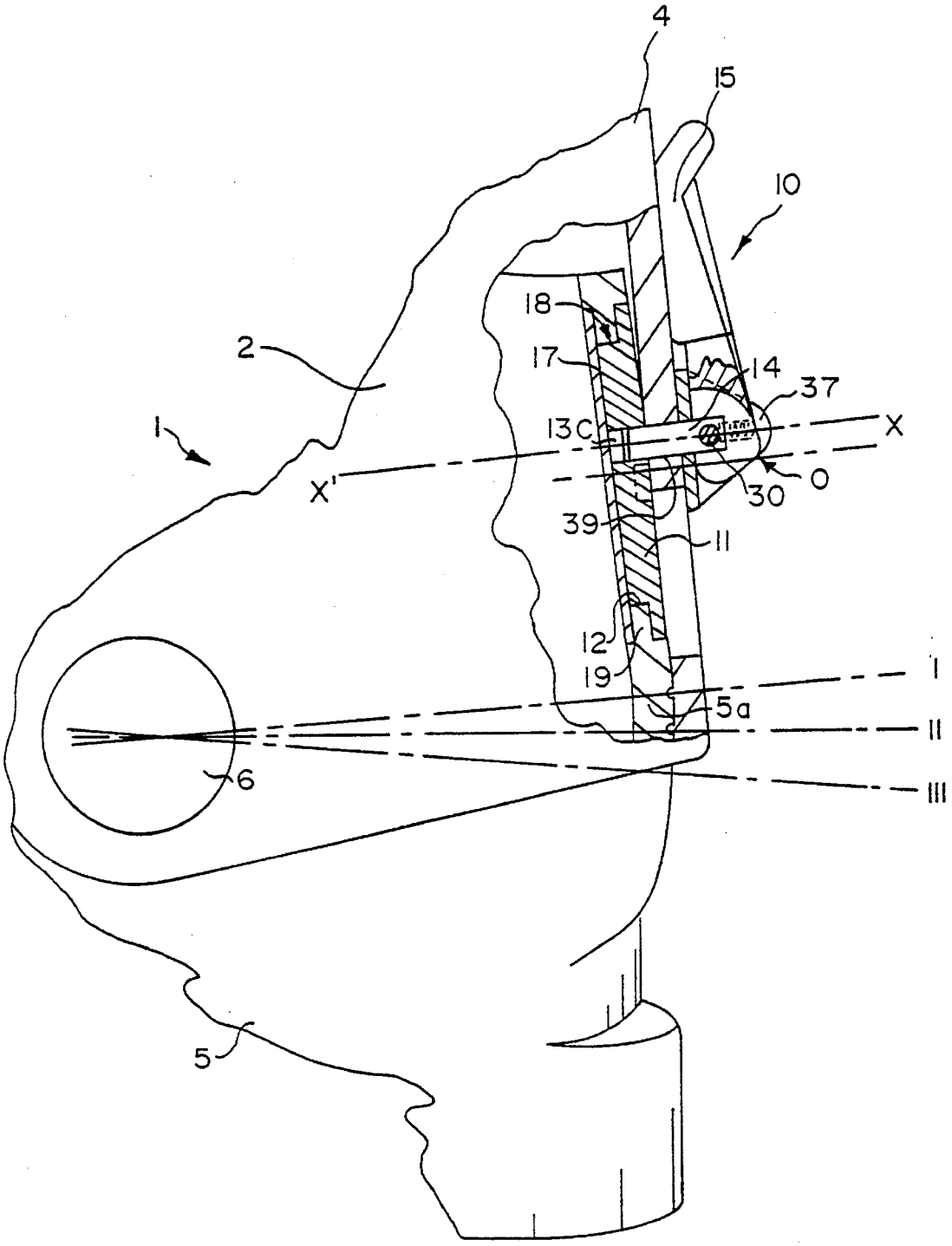
Figure 4:
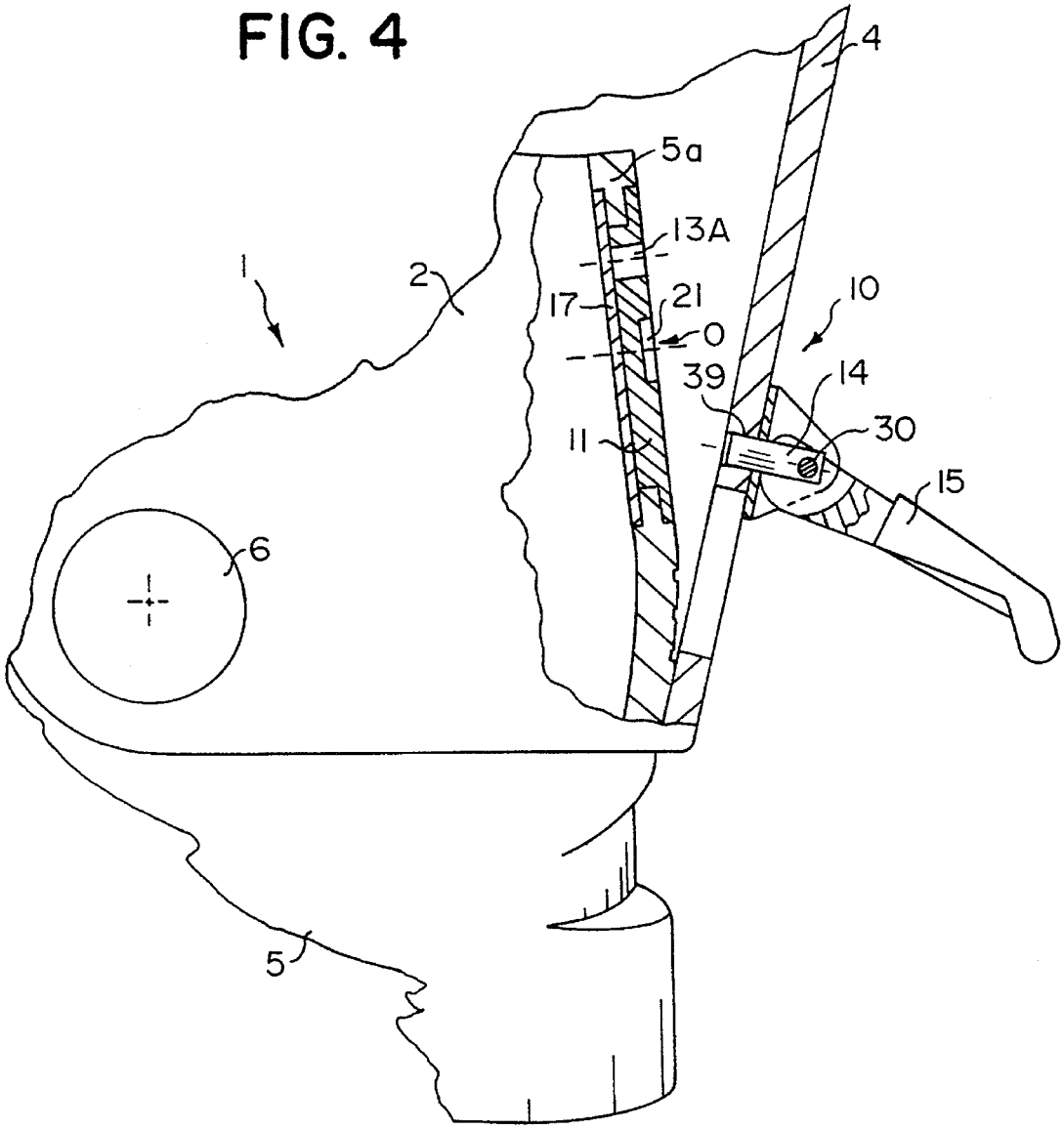
FIG. 4 is a partial sectional view of a boot according to FIGS. 1–3, whose unlatched upper is opened by a rearward rocking of its rear portion.

As shown in FIG. 2, the rotational movement of the plate 11 in view of its angular adjustment is provided in this embodiment by means of a tool 20, such as a screwdriver point engaged in a central slit 21 of the plate 11.

Figure 5:
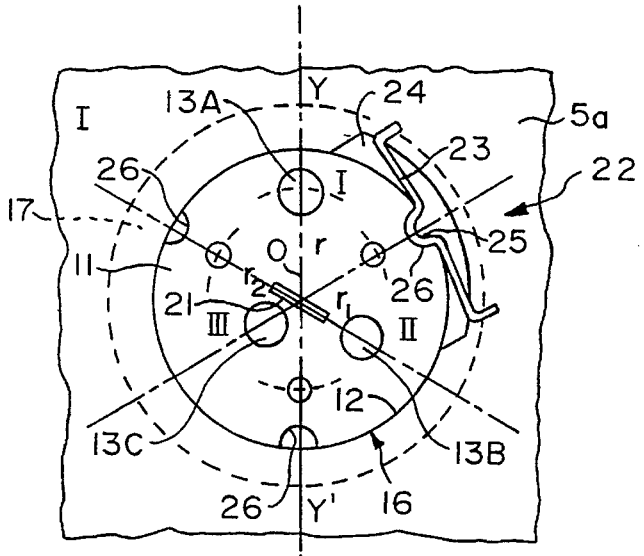
FIGS. 5, 6, 7, show a member for adjusting the latching and unlatching device according to three adjustment positions of the advance of the upper, viz., maximum, intermediate and minimum, respectively.
Figure 6:
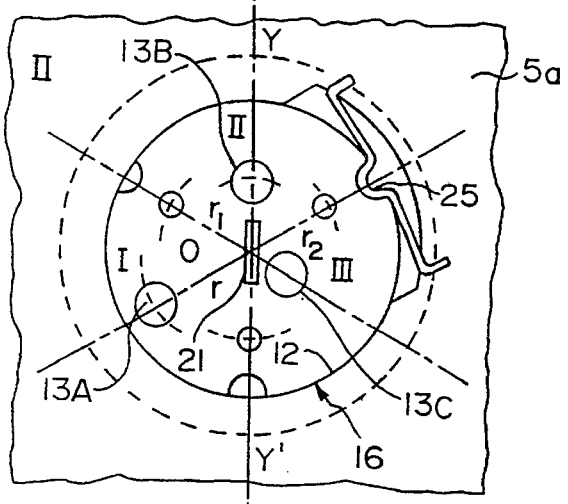
Figure 7:
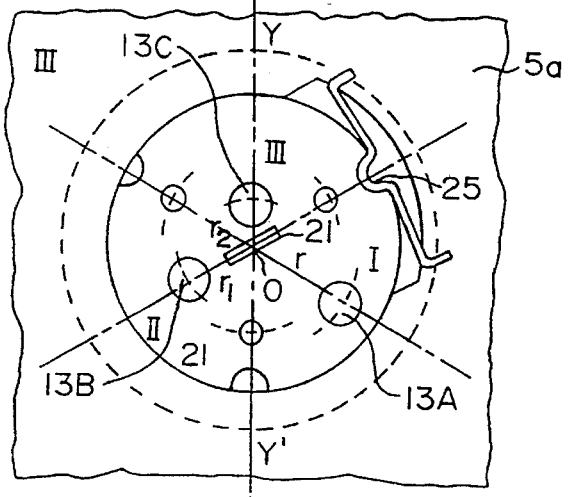

As shown particularly well in FIGS. 5, 6 and 7, the plate 11 includes indexation means 22 according to a chosen position, the means including an elastic element 23 located in a peripheral recess 24 of its housing 12, and by a bump 25 that, acting tangentially, is arranged to cooperate with at least one corresponding inside recess 26 arranged on the periphery of the plate 11, such that each of the orifices 13A, 13B, 13C can become located, in turn, in the vertical axis Y–Y' in order to coincide with the latching finger 14 according to a chosen position I, II, III.

According to the present example, plate 11 includes three inside recesses 26 determining three indexation points located at 120° from one another and corresponding to three adjustment positions I, II, III of the upper 2, provided by the three adjustment orifices 13A, 13B, 13C, also located at 120° from each other, but offset by 60° with respect to the indexation points.

According to an improvement of the invention, each of the advance positions I, II, III, of the upper 2, with respect to the shell base 5, is denoted by reference marks 27, 28, 29 carved into the latter, as illustrated schematically in FIGS. 1, 2, 3 and 4.

Thus, for a maximum advance of the upper 2 according to position I, with respect to a vertical axis, the bottom surface edge 4*a* of the rear portion 4 of the upper 2 is located opposite reference mark 27, finger 14 then being in latching position in orifice 13A situated in vertical axis Y–Y', of part 11, i.e., furthest from its virtual center 0 (FIGS. 2 and 5).

In addition, for an advance of the upper 2 along position II, the bottom surface edge 4*a* of the rear portion 4 of the upper 2 is located opposite reference mark 28, finger 14 then being in orifice 13B brought into vertical axis Y–Y' (FIG. 6) after having made plate 11 rotate 120° about its axis X–X' via tool 20.

Lastly, for a minimum advance of the upper 2, along position III, the bottom surface edge 4*a* of the rear portion 4 of the upper 2 is located opposite reference mark 29, finger 14 then being in orifice 13C brought into vertical axis Y–Y' (FIGS. 3, 7), after 120° rotation of plate 11 about its X–X' axis via tool 20.

Of course, each of these adjustments just enumerated, to obtain positions I, II or III, is accomplished after unlatching finger 14 via lever 15.

Figure 9:
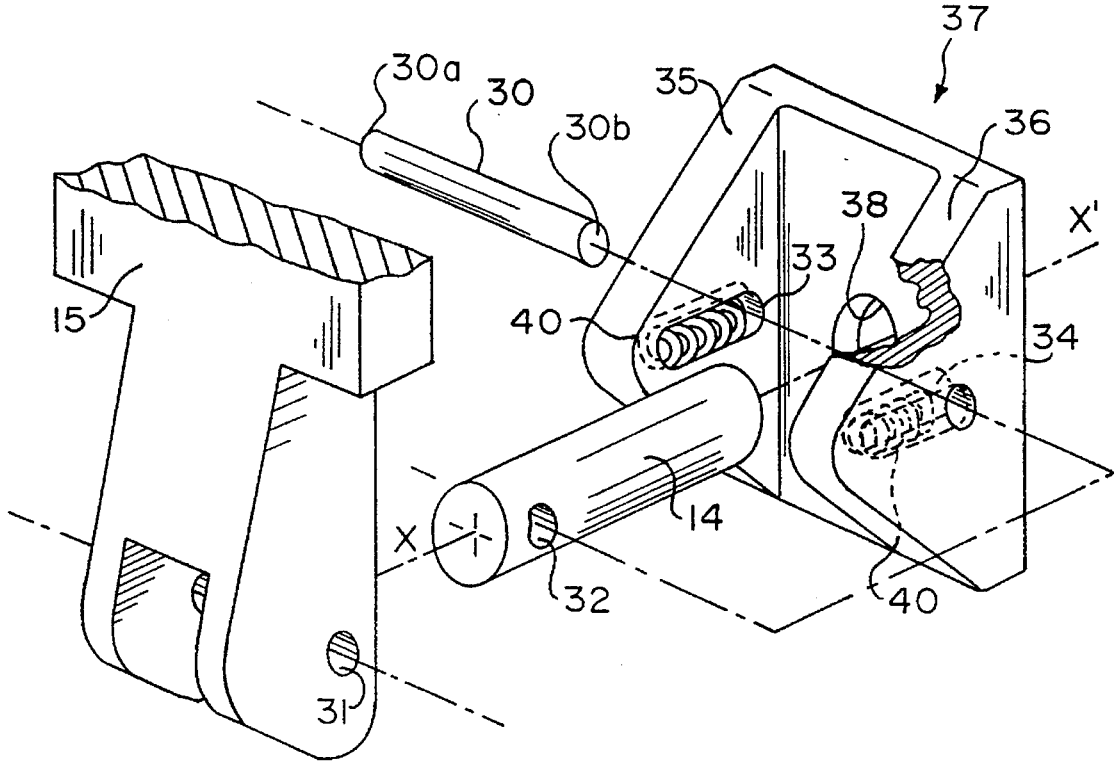
FIG. 9 is a detailed view, in exploded perspective, of the exterior control member for latching and unlatching the upper.

As illustrated in FIG. 9 in particular, latching finger 14 is linked and journalled to lever 15 via a journal axis 30 crossing at the same time the corresponding transverse orifices 31 and 32, of lever 15, and of finger 14.

Axis 30 is journalled by its ends 30*a* and 30*b* in two housings 33 and 34 provided on the lateral flanges 35, 36 of a cap 37 affixed by any known means such as screws, glue, etc., to the rear portion 4 of the upper 2.

The cap 37 includes a central orifice 38 opposite which orifices 13A, 13B, 13C are aligned, chosen from plate 11 cited above, so as to cause the finger 14 to penetrate therein after having crossed an orifice 39 (FIGS. 3, 4) of the rear portion 4 of the upper 2.

Moreover, the control member 15 of the latching finger 14 includes a return means in the active position I, II or III, chosen prior to a resting or walking phase, enabling resumption of the active position automatically by a latching action on the control member 15 and pivoting the upper 2 of the boot to position the finger 14 opposite orifice 13A, 13B or 13C situated in the vertical axis Y–Y'.

In this embodiment, the return means of the control member 15 includes springs 40 acting in a permanent manner on latching finger 14.

These return springs 40 are situated in housings 33 and 34 of the cap 37, in this case blind oblong slots on the exterior side, yet having an open assembly aperture, such that the springs 40 are enclosed therein and exert a return elastic force on the ends 30*a* and 30*b* of axis 30 housed on both sides of housings 33 and 34.

In this way, after an active phase of skiing (FIG. 2 or 3), when the user releases the upper 2 by rocking lever 15 (FIG. 4) in order to walk or rest, after pulling back the lever 15, an automatic re-coupling of the finger 14 in orifice 13A, 13B or 13C will follow, the orifice being located at that time in the vertical axis Y–Y', corresponding to the last position I, II or III of the upper 2 by action of the springs 40 along the axis 30 of the finger 14, along the longitudinal axis X–X'. As a result of this operation, the device according to the invention memorizes the last active position.

Numerous variations of the embodiment can be envisioned while remaining within the same inventive concept. It is thus, for example, that the multi-position member could be a square plate capable of being positioned about the longitudinal axis X'–X by successive rotations of 90°, or even triangular by rotation of 120° about the same axis. In these two types of construction envisioned, it is clear that the housings embedded in the shell base will be of corresponding forms.

In this connection, although the invention has been described with reference of particular means, materials and embodiments, it is to be understood that the invention is not limited to the particulars disclosed and extends to all equivalents within the scope of the claims.

The instant application is based upon French patent application No. 94.00402 of Jan. 12, 1994, the disclosure of which is hereby expressly incorporated by reference thereto, and the priority of which is hereby claimed.

What is claimed is:

1. An alpine ski boot comprising:

a rigid shell base overlaid by an upper, the upper having a front portion and a rear portion provided in one or several pieces, the rear portion of said upper being at least partially pivotal in a rear-to-front and/or front-to-rear direction with respect to the shell base and including a device for latching and unlatching the upper with respect to the shell base, accessible from the exterior of the boot via a control member, the latched position of the latter, corresponding to an initial adjustable reference advance position, from which the upper is capable of an angular clearance along an amplitude predetermined with respect to the shell base;

wherein the latching and unlatching device includes a multi-position member capable of being displaced angularly about a longitudinal axis (X–X') of the shell base in a corresponding co-axial housing arranged in a rear portion of the shell base, and including a plurality of orifices radially off-centered with respect to the virtual center (0) of the multi-position member according to different radius values (r, r1, r2), such that one of the orifices, chosen as a function of a desired initial advance of the upper, can be brought into a vertical axis (Y–Y') in order to coincide with a latching finger affixed to the upper, the latching finger being activated from the exterior of the boot through a wall of the upper by the control member in order to cooperate positively with the chosen orifice of the multi-position member during an active phase of skiing or separated therefrom during a resting or walking phase.

2. A ski boot according to claim 1, wherein the multi-position member comprises a cylindrical plate arranged to swivel freely in the housing of the shell base, of a corresponding form.

3. A ski boot according to claim 2, wherein the plate includes a peripheral shoulder defining, together with an attached counterplate, a groove suited to cooperate with a flange of a corresponding form bordering the housing of the shell base, in such a way that it is affixed to the shell base in a longitudinal direction and cannot be lost.

4. A ski boot according to claim 2, wherein the rotational movement of the plate in view of its angular adjustment is provided via a tool engaged in a central slit of said plate.

5. A ski boot according to claim 2, wherein the plate includes an indexation means according to a chosen position, consisting of an elastic member located in a peripheral recess of its housing, and a bump that, acting tangentially, is arranged to cooperate with at least one corresponding inside recess arranged on the periphery of said plate, such that each of the orifices can be located, in turn, in the vertical axis (Y–Y') to coincide with the latching finger according to a chosen position (I, II, III).

6. A ski boot according to claim 5, wherein the plate comprises three indexation points determined by three inside recesses located 120° from one another, corresponding to three adjustment positions (I, II, III) of the upper, provided by the three adjustment orifices also located 120° from each other, but offset by 60° with respect to said indexation points.

7. A ski boot according to claim 1, wherein the latching device is located in the lower zone of the rear portion of the upper.

8. A ski boot according to claim 1, wherein each of the advance positions (I, II, III) of the upper with respect to the shell base is denoted by reference marks carved into the shell base.

9. A ski boot according to claim 1, wherein the control member of the latching finger includes a return means in the active position (I, II, III) chosen prior to a resting or walking phase, allowing resumption of said active position, automatically by a latching action on the control member.

10. A ski boot according to claim 9, wherein the return means of the control member includes return springs acting in a permanent manner on the latching finger.

* * * * *